United States Patent [19]

Madrange et al.

[11] Patent Number: 4,610,261

[45] Date of Patent: Sep. 9, 1986

[54] PROCESS FOR TREATING THE HAIR AND IN PARTICULAR THE TIPS OF THE HAIR AND DEVICE FOR CARRYING OUT THE SAID PROCESS

[75] Inventors: Annie G. Madrange, Saint German En Laye; Jean-Louis L. Refregier, Conflans Sainte Honorine, both of France

[73] Assignee: L'Oreal, Paris, France

[21] Appl. No.: 522,216

[22] Filed: Aug. 11, 1983

[30] Foreign Application Priority Data

Aug. 16, 1982 [FR] France ..... 82 14178

[51] Int. Cl.[4] ..... A45D 7/00

[52] U.S. Cl. ..... 132/7

[58] Field of Search ..... 132/7

[56] References Cited

U.S. PATENT DOCUMENTS 4,205,692 6/1980 Losenno ..... 132/9

4,481,961 11/1984 Bauer et al. ..... 132/7

FOREIGN PATENT DOCUMENTS 357161 11/1961 Switzerland ..... 132/7

*Primary Examiner*—John J. Wilson

*Attorney, Agent, or Firm*—Cushman, Darby & Cushman

[57] ABSTRACT

A process of and apparatus for conditioning the hair, especially the tips thereof. After the hair has been dampened, for example by shampooing, and optionally dried, either partially or completely, it is subjected to a conditioning step in which it is maintained in an atmosphere having a relative humidity of from about 40 to 80% and at a temperature of from about 35° to 75° C. A special hood may be provided for use in the conditioning operation.

19 Claims, 4 Drawing Figures

Figure 1:
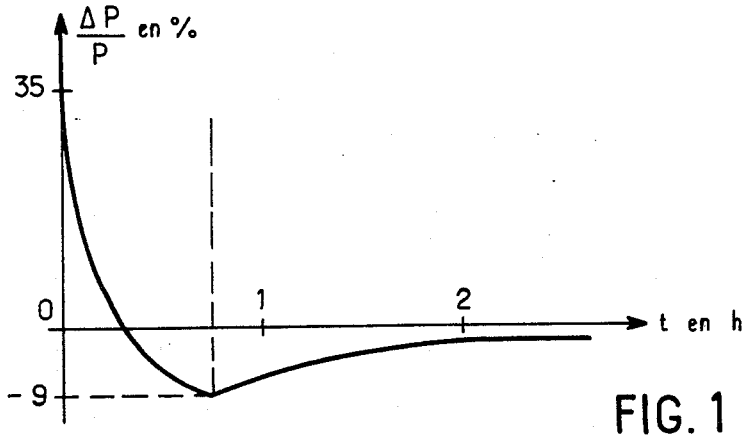

PROCESS FOR TREATING THE HAIR AND IN PARTICULAR THE TIPS OF THE HAIR AND DEVICE FOR CARRYING OUT THE SAID PROCESS

The present invention relates to a new process for carrying out a hair treatment which makes it possible to achieve an improved condition of the hair, and in particular of the tips of the hair, and also to devices for carrying out the said process.

The process according to the invention is applied at the time of drying the hair which has been wetted with water or shampooed. Furthermore, it is intended for hair which, once it has been made wet or damp, is left free for drying, that is to say is not wound onto setting rollers. For a convenient expression, this will be referred to in the remainder of the present description as "free hairstyles".

The current technique generally employed for drying free hairstyles consists in exposing the hair to the heat produced by one or more infrared lamps. This drying takes place either without ventilation or with very slight ventilation.

This drying method causes the hair to dry out, and a series of drying operations of this type rapidly leads to a deterioration in the appearance of the hairstyle. This disadvantage is particularly unpleasant in the case of curly hairstyles which are obtained by a treatment of the perming type and which are most generally dried by this technique.

This drying-out of the hair is explained by the high temperature to which it must be subjected in order to achieve sufficiently rapid drying, under conditions of slight ventilation which do not disturb the hair. Excess heat is applied to the hair located on the surface, which then undergoes excessive drying-out capable of resulting in splitting of the keratin fibers at the fragile points, in particular at the tips of the hair, which become forked and whitish in color. Consequently, the hair is not silky to the touch, it is less shiny and its overall shape is impaired because it has less bulk.

The present invention makes it possible to overcome this disadvantage, because it relates to a special drying technique enabling the excessive drying-out of the hair, such as occurs with the customary drying techniques, to be avoided or compensated.

It has been found that the damp treatment to which hair is subjected in the course of wetting with water or shampooing causes an increase in the weight of the hair, the relative change in weight being of the order of 35%. Drying the hair in a stream of hot air results in a water loss which is greater than the increase in weight of the hair during the damp treatment, and, when drying has finished, the change in the weight of the hair relative to the weight before damp treatment is generally of the order of −9%; of course, this weight loss essentially depends on the drying and, in particular, on the drying time and the temperature of the forced air used. When the drying is complete, it is found that the hair gradually takes up moisture again from the atmosphere, and this behavior of the hair has been shown in FIG. 1 of the attached drawing; in general, the hair takes several hours to return to the weight which it initially had before the damp treatment.

French Patent Application No. 2,483,200 studied the phenomena which take place during the drying of hair wound on rollers. This study made it possible to demonstrate that a phenomenon takes place in the hair after the water uptake has ended.

As explained in the abovementioned patent application, this phenomenon could consist of a rearrangement of the constituent molecules of the hair, and, without this explanation implying any limitation, it was suggested that the damp treatment of the hair enables the water to penetrate into the hair and increases the dielectric constant of the medium existing between the charged sites of the constituent molecules of the hair, with the result that the hydrogen bonds no longer exists for the wet hair. When the hair is dried, the water molecules are extracted from the hair in an amount such that a weight loss relative to the initial weight is observed; the charged sites of the constituent molecules of the hair which had been separated because of the presence of the water molecules remain relatively separated and do not allow the hydrogen bonds to re-form instantaneously at ambient temperature, this re-formation only taking place gradually at a relatively slow rate. The water molecules which return to the hair at ambient temperature to ensure the uptake of water after drying is complete are in the form of agglomerates which are the larger the lower the temperature, and the rearrangement of these water molecules in the hair takes place slowly.

It is therefore seen that, on the one hand, the rearrangement of the distribution of the water in the hair, and on the other hand, the re-formation of the hydrogen bonds in the hair are phenomena which take place slowly at ambient temperature and which probably constitute what was previously called the rearrangement of the hair.

This rearrangement, which is a slow phenomenon, takes place with even greater difficulty in the case of free hairstyles dried by infrared radiation, because, as indicated above, this method of drying dries the hair out too much, at least on the surface.

According to the present invention, it was considered that, while increasing the rate of rearrangement of the hair by increasing the temperature at which this rearrangement takes place, it was possible to ensure the uptake of water by the hair during this rearrangement, so that the hair returns to a condition in which it is approximately in hygrometric equilibrium with the atmosphere at ambient temperature. It was therefore envisaged, according to the invention, to subject the hair to a conditioning stage during which a fairly high relative humidity is maintained. To obtain a rapid rearrangement, it was found that it was necessary to place the hair in an atmosphere at a temperature of between about 35° C. and 75° C. and having a relative humidity of between about 40 and 80%.

According to the invention, the conditioning stage is carried out (starts) either on damp hair or on totally or partially dried hair. If the conditioning stage starts when the hair is still damp, that is to say when it has not yet lost all the water absorbed during washing, the expected rapid rearrangement does not proceed to completion, that is to say it takes place on the surface, and if the drying is pursued to a point where the hair shows a water loss relative to its initial condition, the conditioning stage necessarily ensures an uptake of water by the hair, and the expected rapid rearrangement takes place to completion, that is to say as far as the core of the fibers.

However, in the case of the process according to the present invention, to achieve an improvement in the condition of the tips of the hair it suffices for the rapid rearrangement to take place on the surface. The breakage of the hair which occurs when the hair is dried out will thus be avoided.

The present invention consequently relates to a process for improving the condition and the appearance of the hair, in particular the tips of the hair, wherein, after the said hair has been subjected to a damp treatment, it is subjected to a conditioning state carried out in an atmosphere having a relative humidity of between about 40 and 80% and at a temperature of between about 35° and 75° C., the hair which has undergone the damp treatment being left free for the conditioning stage.

After the damp treatment, the hair is shaped by the customary technique for free drying; for example, the hair in the damp state is shaped with a comb according to the desired hairstyle.

According to the present invention, before undergoing the said conditioning stage, the hair can be subjected to at least partial drying. If the hair is dried, the drying is carried out in two stages; the first stage corresponds to normal drying in which a stream of hot air is supplied with a moderate force calculated so as to disturb the hair, or so as not to disturb it to an appreciable extent; the second stage corresponds to supplying a stream of hot air (at 35° to 75° C.), also with a moderate force, which has a relative humidity within the abovementioned range of values.

The conditioning stage is started at a moment chosen within an interval of time which begins when the hair has been dried sufficiently to show a water loss relative to its initial state before the damp treatment. Preferably, the said time interval begins when the hair has lost about 50% of the water absorbed during the damp treatment, and ends when the hair has lost about 15% of its weight, relative to the weight of the hair before the damp treatment.

In a preferred embodiment of the process according to the invention, the relative humidity of the conditioning stage is set at a value similar to the relative humidity of the ambient atmosphere with which the hair will be in contact after the treatment; the temperature during the conditioning stage is kept at a value of between 35° and 60° C. and preferably of the order of 50° C.; in the case where the hair has been dried prior to conditioning, the temperature of the atmosphere with which the hair is in contact during the conditioning stage is kept at a value similar to the temperature used during the hair drying stage; the conditioning stage is carried out for a period of between about 5 and 60 minutes and preferably of between 10 and 20 minutes; the conditioning stage is carried out by injecting water vapor into the atmosphere with which the hair is in contact.

During the conditioning stage, a treatment product can optionally be injected into the atmosphere with which the hair is in contact. The term "treatment product" is understood as meaning a product normally used in cosmetics, such as antiseborrhoea agents, antidandruff agents, hair loss preventatives, film-forming resins, deodorants, disinfectants, perfumes, brilliantine and the like.

If it is desired to dry the hair totally, this drying is carried out until a relative humidity of the order of 15% is reached in the atmosphere surrounding the hair; the hair is dried until the weight loss obtained, relative to the weight of the hair before the damp treatment, is between 1 and 15% and preferably between 5% and 15%; the hair is dried at a temperature of between 40° and 75° C. for a period of between 10 and 60 minutes, and this is carried out by ventilation with air taken from outside and heated, in an open circuit.

Provision can be made for the initial damp treatment of the hair to be wetting with water and/or shampooing and/or a cosmetic treatment involving wetting the hair with an aqueous or aqueous-alcoholic solution, for example a solution of strengthening agents such as resins; after the conditioning stage, a non-wetting cosmetic treatment, such as spraying with lacquer, can be applied to the hair.

The hair treated by the process according to the invention can be natural, bleached, colored or permed hair.

This process ensures the rapid rearrangement of the keratin fibers, at least on the surface, which improves the shine and the general appearance of the hairstyle. Furthermore, a surprising effect has been observed as regards the waves which can be given to the hair if desired. Under the abovementioned optimal conditions, these waves appear more attractive and have a more natural appearance, the hair then appearing to be in better condition.

The present invention also relates to a device intended for carrying out the process defined above, which comprises means for regulating the relative humidity of the atmosphere with which the hair is in contact. In the case where it is intended for carrying out the process including a step for drying the damp hair, this device also comprises means for carrying out this drying.

In a first embodiment, the device according to the invention consists of two different apparatuses, one of which dries the hair in the case where it is desired to do so, and the other of which carries out the conditioning stage in a more humid atmosphere; the apparatus which dries the hair can be a drying hood of conventional type; the apparatus which carries out the conditioning stage can be a controlled-atmosphere enclosure with gentle air circulation.

In a second embodiment, the device according to the invention consists of a single apparatus operating in two successive cycles, one corresponding to drying and the other to the conditioning stage. In a first variant, the apparatus consists of a flexible cap placed on the hair to be treated and supplied with hot air through a pipe connected to a heating and/or humidifying unit. In another variant, the apparatus consists of a drying hood of conventional type equipped with an element making it possible to inject vapor into the air blown in during the conditioning stage; the injection of vapor can be triggered automatically, either after a predetermined drying time or when a predetermined relative humidity has been reached in the drying atmosphere; the injection of vapor can be controlled by a regulator which keeps the relative humidity of this air at a constant value.

To provide a clearer understanding of the subject of the invention, several embodiments thereof will now be described by way of a purely illustrative and nonlimiting example. The attached drawing shows an explanatory curve relating to the process according to the invention, and diagrams relating to the devices intended for carrying out the process. In this drawing:

FIG. 1 shows the curve giving the % relative change in weight, as a function of time, of wet hair dried at 60°

Figure 2:
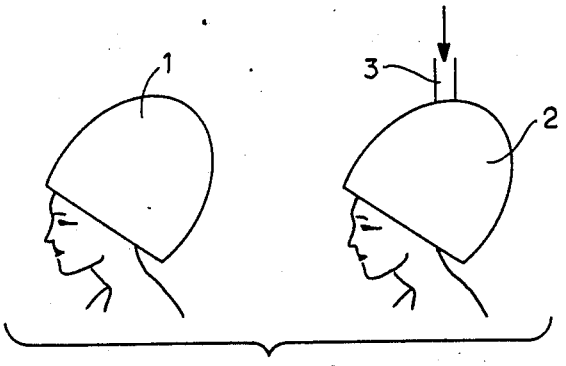
Figure 3:
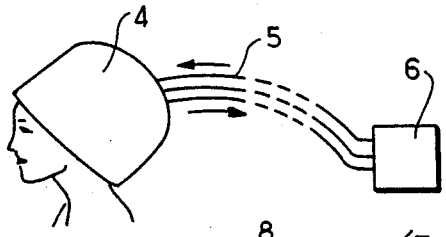
Figure 4:
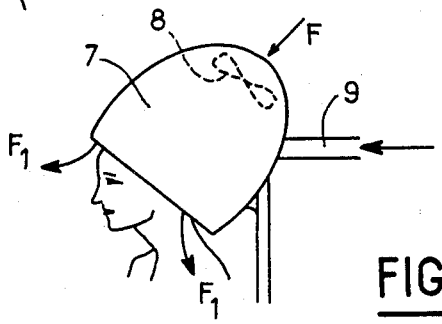

C. for 45 minutes and then left in an atmosphere at 26° C. and 56% relative humidity;

FIG. 2 diagrammatically shows the two apparatuses which constitute the first embodiment of the device for carrying out the process according to the invention;

FIG. 3 diagrammatically shows an apparatus constituting a first variant of a second embodiment of the device for carrying out the process according to the invention; and FIG. 4 diagrammatically shows an apparatus constituting a second variant of the second embodiment of the device for carrying out the process according to the invention.

As already indicated at the start of the present description, FIG. 1 shows that, when wetted, hair undergoes a 35% increase in weight and then, on drying for 45 minutes at 60° C., returns to a weight which is 9% less than its initial weight. When left in an atmosphere at 26° C. and 56% relative humidity, the hair returns to approximately its initial weight about 2 hours after drying is complete.

The conditioning stage according to the present invention can commence when the hair is still damp, that is to say when it has not lost all the water absorbed during washing. By way of example, the conditioning commences after 35 minutes of drying with air at 65° C. and 10% relative humidity, the hair then showing a weight loss of about 6% relative to its initial weight. For this conditioning process, the hair is brought into contact for 20 minutes with an atmosphere at 60° C. and 70% relative humidity. The hair treated in this way is very shiny without any bleaching of the tips.

It is proposed to use several types of device in order to carry out the process according to the invention.

The first type of device is shown diagrammatically in FIG. 2. It comprises a drying hood of conventional type 1, intended for carrying out the drying stage of the process according to the invention, and a controlled-atmosphere enclosure 2 which is different from the drying hood 1, the said controlled-atmosphere enclosure being supplied through the pipe 3 so that it is kept at a constant relative humidity. The temperature inside the controlled-atmosphere enclosure 2 is also kept constant. The user, whose hair has either been wetted with water or wetted with a shampoo and then rinsed, a polymerizable strengthening agent optionally being applied, shapes her hair, for example, by combing it accordingly, and, if appropriate, sits under the drying hood 1. The user then places her hair in the controlled-atmosphere enclosure 2 and keeps it there for the envisaged conditioning time. Then, if desired, the user gives her hair a final combing.

The second embodiment of the device according to the invention is shown diagrammatically in FIG. 3. This figure shows that the user, whose hair has been wetted and shaped as indicated above and who wishes to dry her hair beforehand, places it inside a flexible cap 4, for example made of plastic, the said cap being connected by a pipe 5 to a heating and/or humidifying unit 6. During the drying stage, the unit 6 sends hot air into the cap 4 and the air is discharged through the pipe 5, which serves both to supply and to discharge the said air; the drying air is discharged outside. When the drying stage has ended and the conditioning phase commences, the air circulation provided by the unit 6 no longer takes place in an open circuit but in a closed circuit, and the unit 6 adds to the circulation air a sufficient amount of water to keep a constant relative humidity inside the cap 4. Instead of water, an aqueous or aqueous-alcoholic liquid for treating the hair or scalp can be introduced into the air during the conditioning stage.

In another embodiment, shown in FIG. 4, it is seen that the device according to the invention consists of a drying hood 7 of conventional type, modified so that it can carry out the process according to the invention. The drying hood 7 is equipped with a fan 8 which sucks the air from outside the direction of the arrow F and, after heating, forces it in the direction of the hair, the forced air leaving the hood, around the user's head, in the directions of the arrows F1. The hood 7 is equipped with a device 9 making it possible to inject, into the forced hot air stream, an amount of vapor intended for keeping a constant relative humidity. After the user's wet hair has been shaped, it is placed under the hood 7 and the drying stage of the process is started, if desired. When the drying time has elapsed, the water vapor (or a treatment liquid in the vapor state) is introduced through the pipe 9 throughout the conditioning stage, the amount of vapor being regulated so as to keep a constant relative humidity around the hair.

Of course, the embodiments, described above, of the process and device in no way imply a limitation and may form the subject of any desirable modifications, without thereby exceeding the scope of the invention.

We claim:

1. A process for improving the condition and appearance of hair comprising the steps of (a) subjecting said hair to a dampening treatment; and (b) subjecting the hair treated in step (a) to a conditioning step during which said hair is maintained in an atmosphere having a relative humidity ranging from about 40 to about 80% and at a temperature ranging from about 35° to about 75° C., said hair not being wound on hair rollers during said conditioning step.

2. A process as claimed in claim 1, wherein between steps (a) and (b) the hair is at least partly dried.

3. A process as claimed in claim 2, wherein at the start of the conditioning step (b) the hair is still damp and at the end of the conditioning step (b) the hair has been dried sufficiently so that said hair exhibits a weight loss relative to the weight of the hair before the dampening treatment in step (a).

4. A process as claimed in claim 3, wherein step (b) is commenced when the hair has lost about 50% of the water absorbed during the dampening treatment step (a), and is completed when the hair has lost about 15% of its weight relative to the weight of the hair before the dampening treatment.

5. A process as claimed in claim 3, wherein the hair is dried following step (a) until the weight loss obtained, relative to the weight of the hair before the dampening treatment, is between 1 and 15%.

6. A process as claimed in claim 2, wherein the hair is dried following step (a) until a relative humidity of the order of 15% is reached in the atmosphere surrounding the hair.

7. A process as claimed in claim 2, wherein the hair is dried following step (a) at a temperature of between 40° and 75° C. for a period of between 10 and 60 minutes.

8. A process as claimed in claim 2, wherein the hair is dried following step (a) by ventilation of the hair, in an open circuit, with heated ambient air.

9. A process as claimed in claim 2, wherein the conditioning step (b) is carried out at a temperature similar to that used during the hair drying carried out after step (a).

10. A process as claimed in claim 1, wherein after step (a) and before step (b) the hair is shaped into a desired hair style.

11. A process as claimed in claim 1, wherein during step (b) a stream of hot air is passed over the hair with a force such that the hair is at least substantially undisturbed thereby.

12. A process as claimed in claim 1, wherein the relative humidity during the conditioning step (b) is chosen to be similar to the relative humidity of the ambient atmosphere with which the hair will be in contact after completion of the conditioning.

13. A process as claimed in claim 1, wherein the conditioning step (b) is carried out at a temperature in the range of 35° to 60° C.

14. A process as claimed in claim 1, wherein the conditioning step (b) is carried out for a period of between about 5 and 60 minutes.

15. A process as claimed in claim 14, wherein the conditioning step (b) is carried out for a period of between about 10 and 20 minutes.

16. A process as claimed in claim 1, wherein the conditioning step (b) is carried out by injecting water vapor into the atmosphere with which the hair is in contact.

17. A process as claimed in claim 1, wherein during the conditioning step (b), a treatment product is injected into the atmosphere with which the hair is in contact.

18. A process as claimed in claim 1, wherein the initial dampening treatment of the hair in step (a) is carried out by at least one of wetting with water, shampooing and wetting the hair with an aqueous or aqueous/alcoholic cosmetic treatment solution.

19. A process as claimed in claim 1, wherein the hair treated is natural, bleached, colored or permed hair.

* * * * *